US007712156B2

(12) United States Patent
Raber

(10) Patent No.: US 7,712,156 B2
(45) Date of Patent: May 11, 2010

(54) PROTECTIVE CUP

(76) Inventor: Jeremiah A. Raber, 2308 Mickey Dr., High Ridge, MO (US) 63049

( * ) Notice: Subject to any disclaimer, the term of this patent is extended or adjusted under 35 U.S.C. 154(b) by 128 days.

(21) Appl. No.: 11/903,992

(22) Filed: Sep. 25, 2007

(65) Prior Publication Data

US 2009/0077726 A1 Mar. 26, 2009

(51) Int. Cl.
*A41B 1/02* (2006.01)

(52) U.S. Cl. ..... 2/403

(58) Field of Classification Search ..... 2/455, 2/403, 466; 128/98.1, 99.1, 89.1; 602/72
See application file for complete search history.

(56) References Cited

U.S. PATENT DOCUMENTS

| | | | | |
|---|---|---|---|---|
| 849,471 | A * | 4/1907 | Gamble | 602/72 |
| 4,257,414 | A * | 3/1981 | Gamm et al. | 602/72 |
| 5,479,942 | A * | 1/1996 | DiMatteo | 128/846 |
| 7,178,176 | B1 * | 2/2007 | S-Cronenbold | 2/466 |

* cited by examiner

*Primary Examiner*—Tejash Patel
(74) *Attorney, Agent, or Firm*—Douglas E. Warren

(57) ABSTRACT

A protective cup designed to protect the male genitalia from damage or injury that could result from blows to the pelvic area of a male wherein the protective cup is manufactured using a very high strength ballistic material for the primary protective cup structure and wherein the interior of the protective cup includes a resilient gel that provides additional cushioning to the male genitalia if the protective cup is subjected to heavy strikes from external sources.

17 Claims, 4 Drawing Sheets

PROTECTIVE CUP

CROSS REFERENCE TO RELATED APPLICATIONS

Not applicable.

STATEMENT REGARDING FEDERALLY SPONSORED RESEARCH

Not Applicable.

BACKGROUND OF THE INVENTION

This invention relates to an apparatus and method for manufacturing and using a protective cup that provides shielding for the crotch area of male users.

Males are often involved in activities that include heavy body contact or in other activities where there is a strong likelihood that certain areas of the male body will be subjected to heavy physical blows. As a result of the male anatomy, the pelvic area of a human male can be very susceptible to damage or injury from such heavy blows and fast-traveling projectiles. More specifically, the male genitals are located in the male pelvic area and, due to their essentially exposed and unprotected arrangement, can be damaged by even medium levels of contact with moving objects.

In the case of athletics, this can present a substantial problem for the male athlete. Because blows to the male genitals in the male pelvic area often occur, and because such blows can result in sometime incapacitating pain, various devices have been conceived that can be used to protect the male pelvic area from such injuries.

The most common from of protection is a concave device that can be worn by the male participant that generally covers the male genital area just below the abdomen and between the legs of the male. Such devices have become generically known as "athletic cups" and are extremely common in such sports as football, baseball, basketball, soccer, hockey, and any other sport that might cause the male genital area to receive heavy contact.

The vast majority of those athletic cups are made from some type of plastic material such as polypropylene or polyethylene. In such prior art athletic cups, the edges of the plastic material from which the primary structure for the athletic cup is made are often rimmed around the peripheral with a resilient material such as foam rubber. However, the normal prior art athletic cup has no super resilient material within the internal portion of the athletic cup to provide additional cushioning and protection for the male genitalia being stored within the protective cup.

Additionally, while past designs of athletic cups may be rigid enough to protect from certain blows to the male genital area, the standard athletic cup is not designed or made from a material that can protect against extremely severe blows that can be found in instances other than in general athletic competition. For example, law enforcement officers often find themselves in circumstances where belligerent offenders of the law have no qualm about attacking the law officer by kicking the law officer's genital area, or by striking the law officer's genital area with heavy blunt instruments and even sharp objects. The effects of such tactics can quickly result in the incapacitation of the law officer that could result in the escape of the offender and, in the most sever cases, even serious injury or death of the law officer.

Military personnel and others in the armed services often find themselves in situations similar to that of the law officers as described above. However, military personnel may become involved in combat that can also include attacks by small arms fire and by explosives that direct damaging, fast-moving shrapnel in the direction of the military personnel. If bullets and shrapnel contact the male genital area, the military personnel can be quickly disabled when the projectile strikes the genital area of the male military personnel.

As a result, the athlete, law officer, or military personnel in each of the above scenarios can readily benefit from a protective cup made from high level ballistic material than can offer added protection against blows from heavy objects, small arms fire, and shrapnel.

SUMMARY OF THE INVENTION

In accordance with the present invention, a new type of protective cup is disclosed wherein the protective cup is made from high grade ballistic material and is manufactured in a manner that provides the user with a high degree of protection against injury and damage that might result from attacks against the genital area of male users.

DESCRIPTION OF THE DRAWINGS

In the accompanying drawings which form part of the specification.

Corresponding reference numerals indicate corresponding steps or parts throughout the several figures of the drawings.

While one embodiment of the present invention is illustrated in the above referenced drawings and in the following description, it is understood that the embodiment shown is merely one example of a single preferred embodiment offered for the purpose of illustration only and that various changes in construction may be resorted to in the course of manufacture in order that the present invention may be utilized to the best advantage according to circumstances which may arise, without in any way departing from the spirit and intention of the present invention, which is to be limited only in accordance with the claims contained herein.

DETAILED DESCRIPTION OF AT LEAST ONE EMBODIMENT OF THE INVENTION

A preferred embodiment of the protective cup A of the present invention is illustrated in FIG. 1 through FIG. 4. In this embodiment, the protective cup A is generally concave and is substantially formed and sized to sufficiently cover the male genitalia of an average male between the ages of about 15 to about 45.

The protective cup A comprises various combinations of different materials that have been generally layered to generate a primary shell 1. More specifically, the protective cup A includes the primary shell 1 that has a first outer trim 2 that substantially contacts the perimeter edges of the primary shell 1. The outer edges of the first outer trim 2 have a second outer trim 3 that is substantially disposed around the outer perimeter of the first outer trim 2. It is understood that the second outer trim 3 can be integral with or may be the same as the inner layer of rubber material identified in each of the three exemplary preferred embodiments described below. A plurality of vent openings 4 are located on at least two sides of the protective cup A to allow for limited circulation between the atmosphere within the protective cup and the ambient atmosphere outside the protective cup.

The primary shell 1 is includes at least some materials that can provide a very high degree of ballistic protection against projectiles such as bullets and shrapnel. While any material or combination of materials can be used to attain that characteristic for the primary shell 1, there are preferred embodiments as described in the following that can be used in general to achieve that result.

Figure 1:
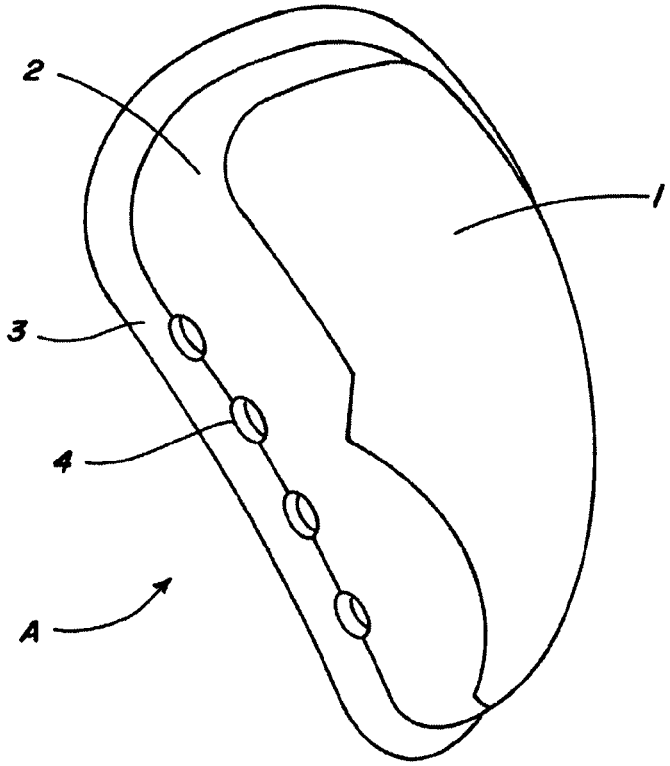
FIG. 1 shows a front perspective view of one embodiment of the present invention.
Figure 2:
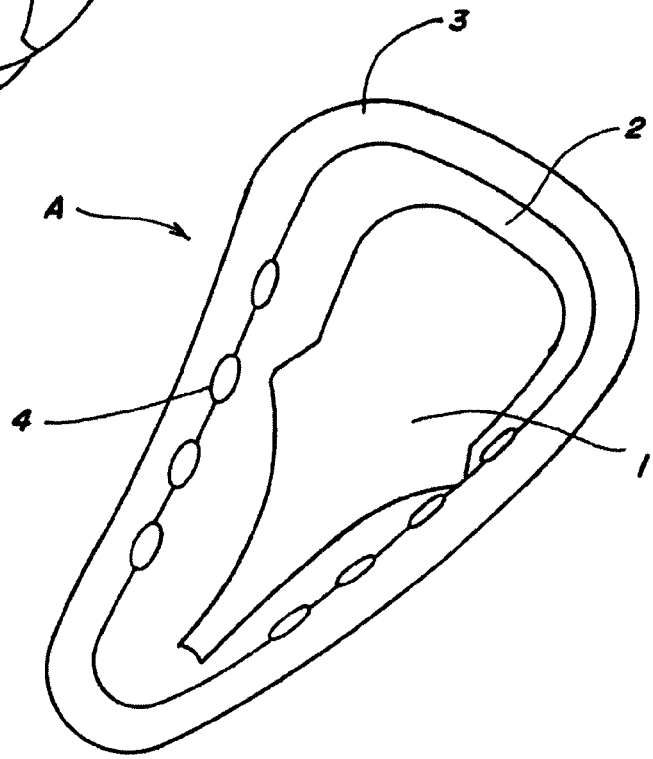
FIG. 2 shows a rear perspective view of one embodiment of the present invention.
Figure 3:
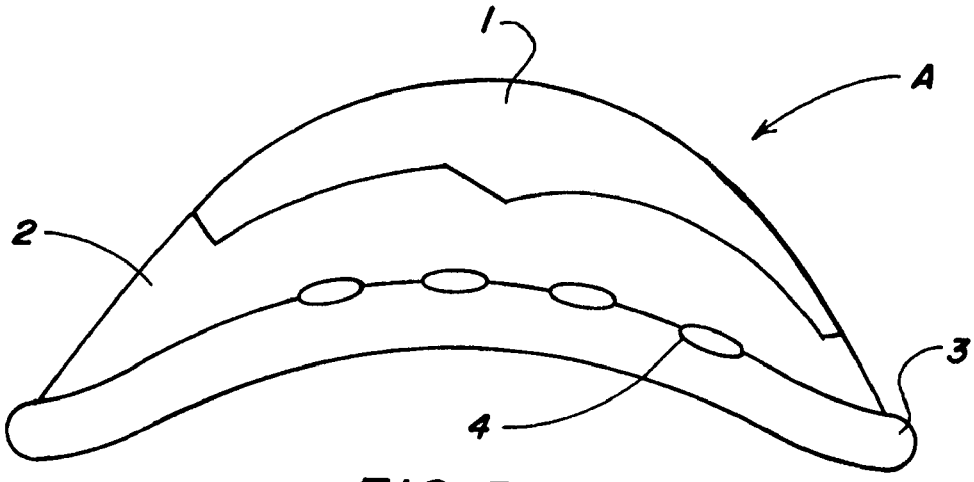
FIG. 3 shows a side view of one embodiment of the present invention.
Figure 4:
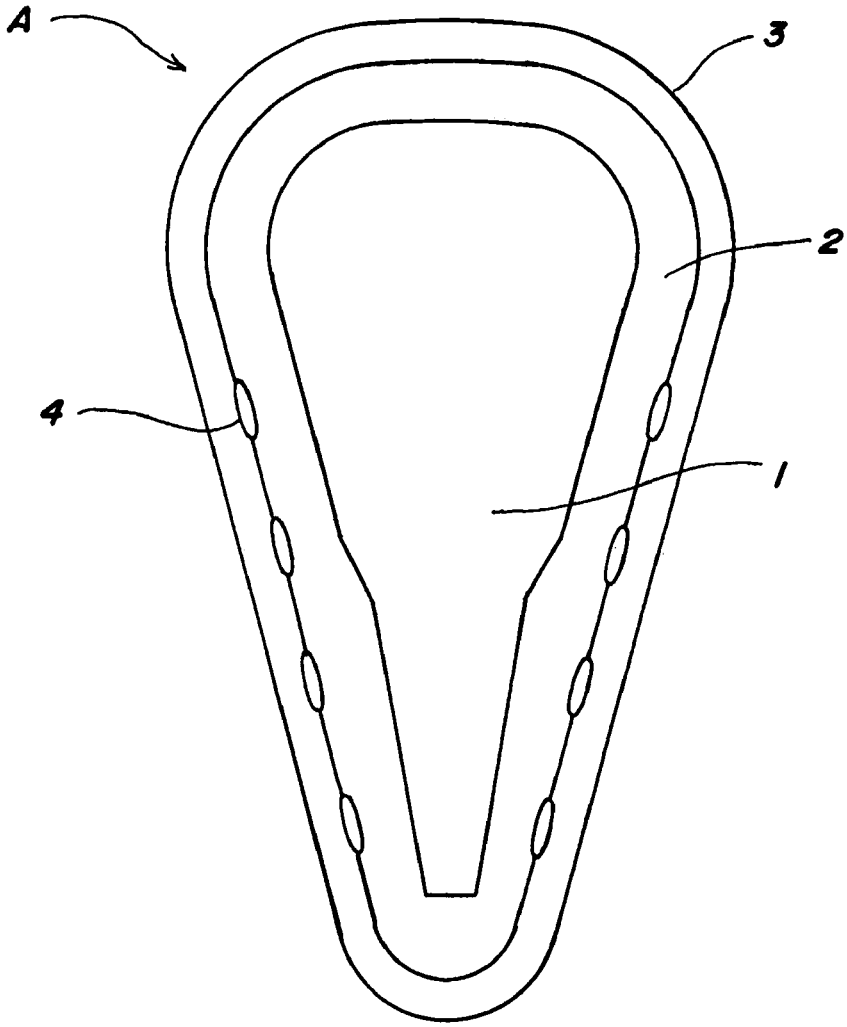
FIG. 4 shows a back view of one embodiment of the present invention.
Figure 5:
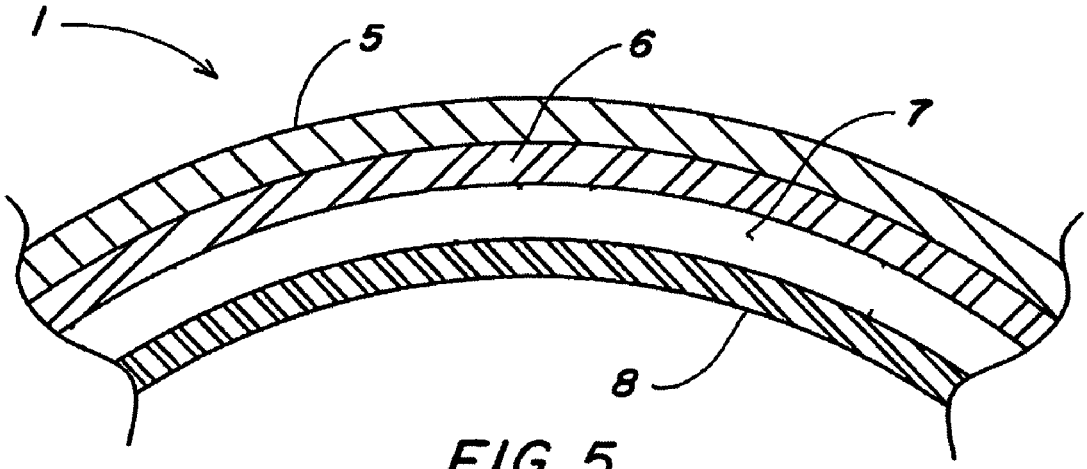
FIG. 5 shows a cross section of one embodiment of the present invention.

For example, in a first preferred embodiment, the primary shell 1 is constructed of a plurality of layers of materials. More specifically, FIG. 5 shows this embodiment of the primary shell 1 as having a first layer 5 of carbon fiber material, a second layer 6 of Kevlar®, a third layer 7 of an extremely resilient silicone gel material, and an inner layer 8 of a medium durometer rubber material. Each of the individual layers may be bonded to an adjacent layer, or each of the individual layers may not be bonded to the adjacent layer, with the choice being determined based upon the particular application for use of the protective cup A. Once all the layers of the primary shell 1 have been assembled, the primary shell is then located within the first outer trim 2 that is in turn located within the second outer trim 3. It will be appreciated by those of ordinary skill in the art that this first preferred embodiment provides a moderately high degree of protection of the pelvic area of males who are participating general sports activities or for general armed security personnel that do not expect to encounter high degrees of small arms fire or shrapnel.

Figure 6:
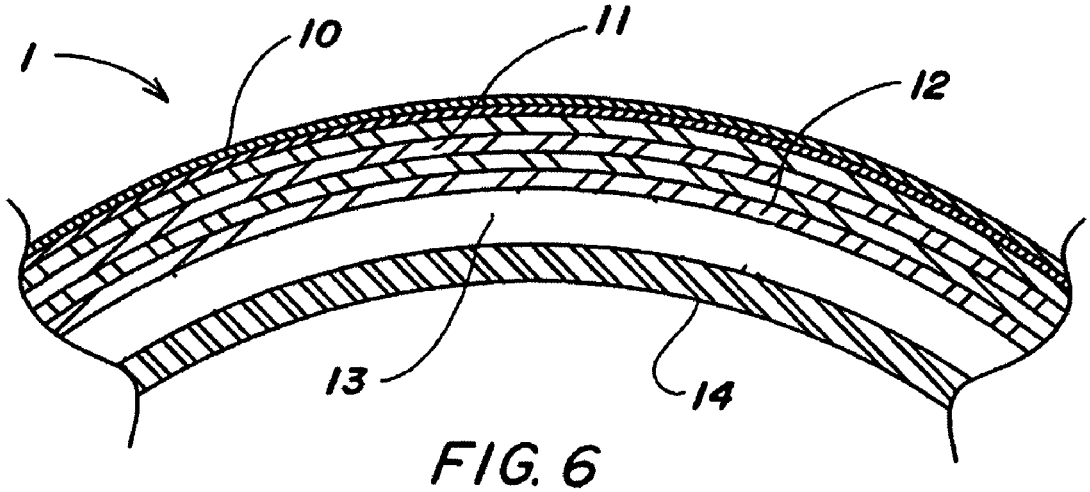
FIG. 6 shows a cross section of a second embodiment of the present invention.

In a second preferred embodiment, the primary shell 1 is also constructed of a plurality of layers of materials. However, as shown in FIG. 6 the combination of materials in each layer is different. In this second preferred embodiment, the primary shell 1 is constructed from a first layer 10 of carbon fiber material, about eight layers of Kevlar® 11, a third layer 12 of a high tensile strength metal, a fourth layer 13 of an extremely resilient silicone gel material, and an inner layer 14 of a medium durometer rubber material. As in the first embodiment, each of the individual layers may be bonded to an adjacent layer, or each of the individual layers may not be bonded to the adjacent layer, with the choice being determined based upon the particular application for use of the protective cup A. Again as in the first embodiment, once all the layers of the primary shell 1 have been assembled, the primary shell is then located within the first outer trim 2 that is in turn located within the second outer trim 3. In this second embodiment, it is understood that the high tensile strength metal in the third layer 12 can be a titanium alloy metal that is about 0.12 inches in thickness. However, it is also understood that any metal can be used as long as the metal selected provides sufficient resistance to against the impact of small arms fire and explosive shrapnel such as to reduce the likelihood of injury to the male genitalia protected by the protective cup A. It will be appreciated by those of ordinary skill in the art that this second preferred embodiment provides a very high degree of protection of the pelvic area of male military personnel who expect to encounter small arms fire and shrapnel.

Figure 7:
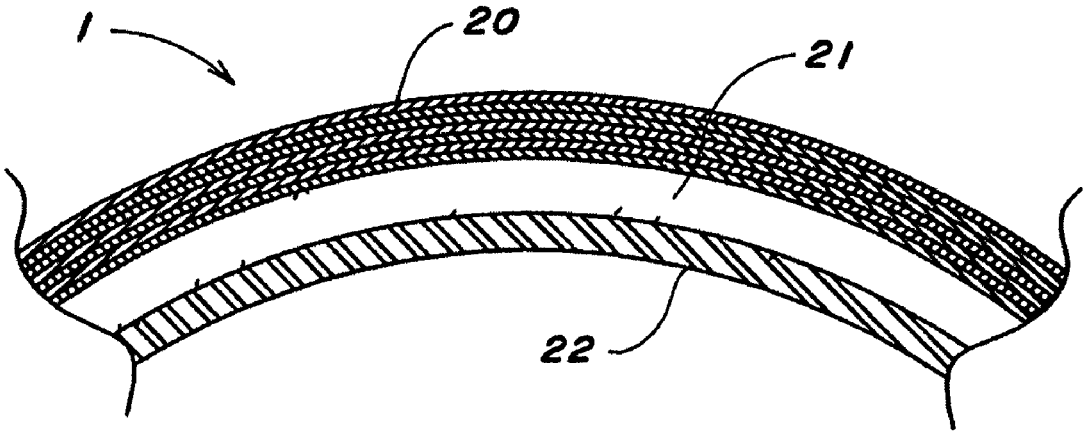
FIG. 7 shows a cross section of a third embodiment of the present invention.
Figure 8:
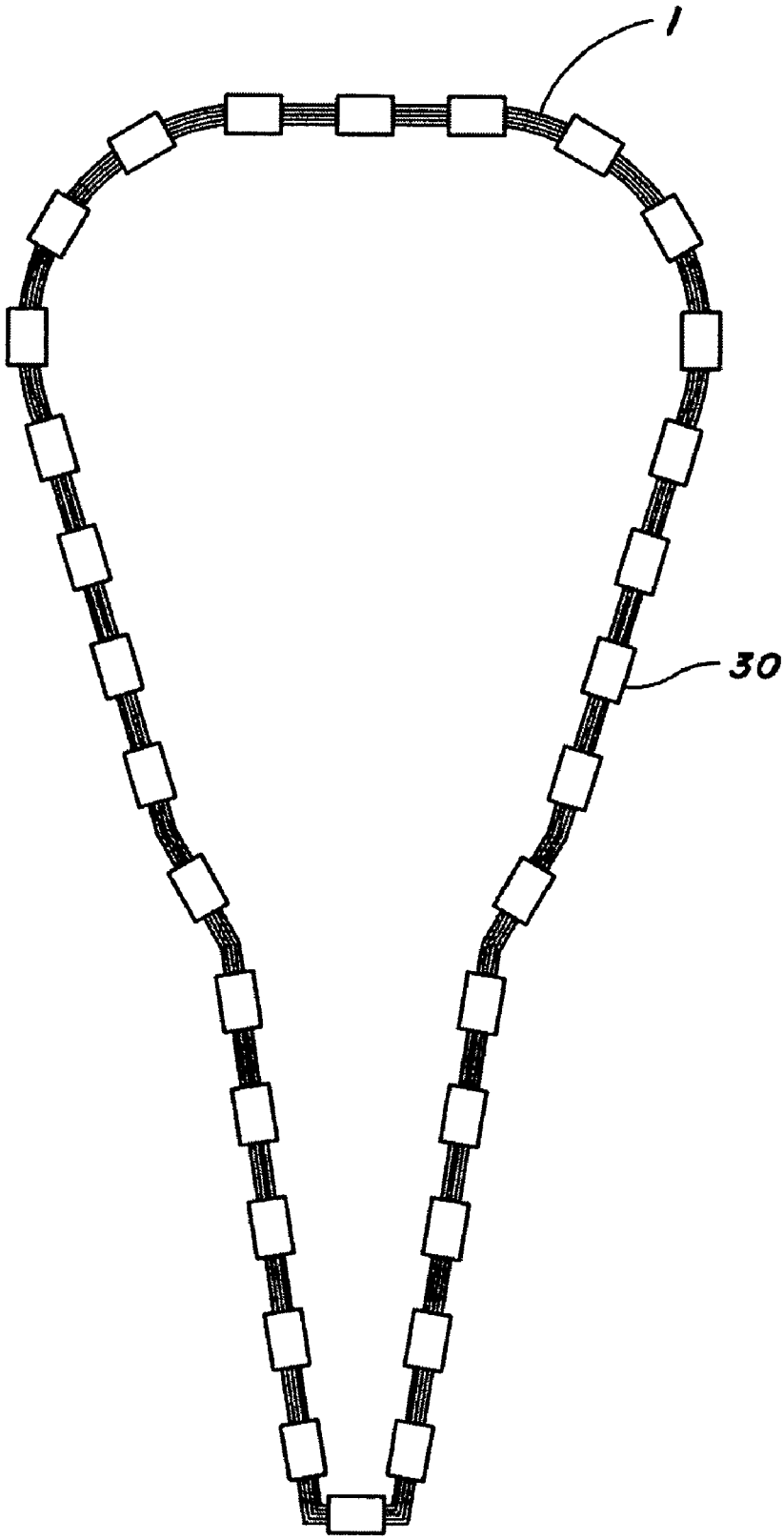
FIG. 8 shows an interior view of one embodiment of the present invention that includes a plurality of clips to aid in the holding of the layers of the primary shell together.

In yet a third preferred embodiment of the present invention, the primary shell 1 is again constructed of a plurality of layers of materials. However, as shown in FIG. 7 the combination of materials in each layer is different. In this second preferred embodiment, the primary shell 1 is constructed from a first layer 20 that includes about ten layers of carbon fiber material, a second layer 21 of an extremely resilient silicone gel material, and an inner layer 22 of a medium durometer rubber material. As in the first embodiment, each of the individual layers may be bonded to an adjacent layer, or each of the individual layers may not be bonded to the adjacent layer, with the choice being determined based upon the particular application for use of the protective cup A. Again as in the first embodiment, once all the layers of the primary shell 1 have been assembled, the primary shell is then located within the first outer trim 2 that is in turn located within the second outer trim 3. It will be appreciated by those of ordinary skill in the art that this third preferred embodiment provides a high degree of protection of the pelvic area of male user's who do not expect to encounter any small arms fire or shrapnel, but who may expect to encounter circumstances where heavy blows to the male genital area may occur.

In each of the three preferred embodiments, carbon fiber materials, and Kevlar® materials have been identified. It is understood that when carbon fiber materials are identified, the preferred embodiments are intended to use carbon fiber within a product formed from carbon filament thread that has been woven into a cloth configuration. The final carbon fiber layer is generally constructed by combining an epoxy resin and/or plastic material with either single or multiple layers of the woven carbon fiber cloth. It is appreciated that this combination of materials results in a product generally referred to as carbon fiber reinforced plastic ("CFRP") that is a very strong and lightweight material than can be readily molded into almost any shape—including the generally concave shape of the protective cup A.

The silicone gel identified in each of the preferred embodiment generally means a silicone gel material having a Shore 00 durometer of less than about 30, with a preferred Shore 00 durometer of between about 0 and about 20.

The Kevlar® identified in the three preferred embodiments is well known in the prior art. Kevlar® is a particularly light but very strong synthetic fiber that does not rust and is non-corrosive and has a common chemical a name of poly-para-phenylene terephthalamide. There are two commonly used commercial grades of Kevlar® which are grade 29 and 49. The Kevlar® 29 composition is considered to have a high tensile strength and is generally preferred for most embodiments of the present invention. However, it is understood that other grade of Kevlar® may also be used and still remain within the intended scope of the present application. Kevlar® is commonly and widely used in the manufacture of body armor and, in certain compositions has been identified as bullet-proof.

The first outer trim 2 may be made of a plastic material having a Shore A durometer of between about 80 and about 90. The second outer trim 3, the inner layer 8, the inner layer 14, and the inner layer 22 can be made of a rubber-like material having a durometer on the A scale of between about 20 and about 40. It is understood that while the durometers noted herein may be preferred for the present invention, other durometer values may be used as required for the specific application in which the protective cup A is intended to be used. In any event, regardless of the durometer used, all durometer values are intended to be within the scope of the present inventions as long as the other characteristics of the protective cup A identified herein are met.

To assist in the general strength of the construction of the primary shell 1, alternative embodiments may include a method by which the multiple layers of the primary shell are generally clamped together at the periphery of the primary shell. For example, FIG. 9 shows the use of a plurality of clips 30 that can be used to clamps the edges of each layer together. The plurality of clips 30 are generally U-shaped and are sized and configured as required to clamp the combined set of layers of material that from the primary shell 1. It is generally preferred that the plurality of clips 30 have a friction fit that allows the internal elements of the plurality of clips 30 to grip the multiple layers that form the primary shell 1 such that the plurality of clips 30 tend to keep the multiple layers in position with each other when the primary shell is subjected to impact from projectiles that are directed toward the protective cup A. In alternative embodiments, the plurality of clips may also be glued into position on the edges of the primary shell 1 to further assist the plurality of clips in maintaining the positional relationship of each of the multiple layers of the primary shell. It is understood that the quantity of the plurality of clips 30 is determined by the overall size of the protective cup A and the degree of fixation desired for the positioning of the multiple layers of the primary shell 1. It is also understood that, after the plurality of clips 30 have been positioned on the edges of the primary shell 1, the first outer trim 2 and the second outer trim 3 are sized and configured to substantially encapsulate the plurality of clips 30 such that the plurality of clips do not contact the user's body or generate discomfort for the user when the protective cup A is placed into position on the pelvic area of the user.

While the above description describes various embodiments of the present invention, it will be clear that the present invention may be otherwise easily adapted to fit any configuration where a protective cup device is required. Additionally, as various changes could be made in the above constructions without departing from the scope of the invention, it is also intended that all matter contained in the above description or shown in the accompanying drawings shall be interpreted as illustrative and not in a limiting sense. The scope of the invention should be determined by the appended claims and their legal equivalents, rather than by the examples given.

What is claimed is:

1. A protective cup comprising:

a primary shell having a first outer trim portion that substantially contacts the perimeter edges of the primary shell, wherein outer edges of the first outer trim portion have a second outer trim portion that is substantially disposed around the outer perimeter of the first outer trim portion, wherein the protective cup is generally concave and is substantially triangular in shape to sufficiently cover the male genitalia of an average male between the ages of about 15 to about 45;

a plurality of spaced apart vent openings located near two side edges of the protective cup to allow for limited circulation between the atmosphere within the protective cup and the ambient atmosphere outside the protective cup;

wherein the primary shell is constructed from material that can provide ballistic protection against projectiles sufficient to reduce the potential of physical damage of male genitalia that have been substantially covered by the protective cup;

wherein the primary shell is constructed of a plurality of laminate layers of materials being coextensive with each other;

a cushioning material disposed on the inner surface of the primary shell; and wherein the cushioning material is a silicone gel having a Shore 00 durometer of less than about 30.

2. The protective cup of claim 1 wherein the silicone gel has a Shore 00 durometer of between about 0 and about 20.

3. The protective cup of claim 2 wherein the first outer trim portion is made of a material having a Shore A durometer of between about 80 and about 90.

4. The protective cup of claim 3 wherein the second outer trim portion and the inner layer of the plurality of layers of material are made of one of either a rubber material or a rubber-like material having a durometer on the Shore A scale of between about 20 and about 40.

5. The protective cup of claim 4 wherein the primary shell comprises a first layer of carbon fiber material, a second layer of Kevlar®, a third layer of an extremely resilient silicone gel material, and an inner layer of a medium durometer material made of one of either a rubber or a rubber-like material.

6. The protective cup of claim 5 wherein the carbon fiber material is provided in the form of carbon reinforced plastic.

7. The protective cup of claim 6 wherein each of the plurality of layers of material are bonded to an adjacent layer.

8. The protective cup of claim 7 further comprising a plurality of clips that substantially clamp the edges of each layer together.

9. The protective cup of claim 8 wherein the plurality of clips are generally U-shaped and are sized and configured as required to clamp the combined set of layers of material that from the primary shell.

10. The protective cup of claim 4 wherein the primary shell comprises a first layer of carbon fiber material, a second layer comprising a plurality of layers of Kevlar® material, a third layer of a high tensile strength metal, a fourth layer of an extremely resilient silicone gel material, and an inner layer of a medium durometer material made of one of either a rubber or a rubber-like material.

11. The protective cup of claim 10 wherein the carbon fiber material is provided in the form of carbon reinforced plastic.

12. The protective cup of claim 11 further comprising a plurality of clips that substantially clamp the edges of each layer together.

13. The protective cup of claim 12 wherein the plurality of clips are generally U-shaped and are sized and configured as required to clamp the combined set of layers of material that from the primary shell.

14. The protective cup of claim 4 wherein the primary shell comprises a first layer that comprises a plurality of layers that include carbon fiber material, a second layer of an extremely resilient silicone gel material, and an inner layer of a medium durometer material made of one of either a rubber or a rubber-like material.

15. The protective cup of claim 14 wherein the first layer comprises ten sub-layers that include carbon fiber material.

16. The protective cup of claim 15 wherein the carbon fiber material is provided in the form of carbon reinforced plastic.

17. The protective cup of claim 16 further comprising a plurality of clips that substantially clamp the edges of each layer together and wherein the plurality of clips are generally U-shaped and are sized and configured as required to clamp the combined set of layers of material that from the primary shell.

* * * * *